US006334269B1

(12) United States Patent
Dilks

(10) Patent No.: US 6,334,269 B1
(45) Date of Patent: Jan. 1, 2002

(54) WINCH ACTUATOR FOR ATV

(75) Inventor: Jerry L. Dilks, Milwaukie, OR (US)

(73) Assignee: Warn Industries, Inc., Milwaukie, OR (US)

( * ) Notice: Subject to any disclaimer, the term of this patent is extended or adjusted under 35 U.S.C. 154(b) by 0 days.

(21) Appl. No.: 09/286,122

(22) Filed: Apr. 2, 1999

(51) Int. Cl.[7] ..... E01H 5/04

(52) U.S. Cl. ..... 37/235; 37/231; 172/63; 172/795; 172/829; 180/908

(58) Field of Search ..... 172/77, 63, 795, 172/797, 817, 829; 37/235, 219, 271, 231; 180/908

(56) References Cited

U.S. PATENT DOCUMENTS

| | | | | | |
|---|---|---|---|---|---|
| 1,743,969 | A | | 1/1930 | Heinzen | |
| 2,166,424 | A | | 7/1939 | Coates | |
| 2,420,592 | A | | 5/1947 | Frame | |
| 4,369,590 | A | | 1/1983 | Miller | |
| 4,403,432 | A | | 9/1983 | Biance | |
| 4,821,436 | A | | 4/1989 | Slocum | |
| 4,907,358 | A | * | 3/1990 | Moore | 37/232 |
| 4,955,781 | A | * | 9/1990 | Holladay | 414/786 |
| 4,991,323 | A | | 2/1991 | Benkler | |
| 5,193,296 | A | * | 3/1993 | Reilley | 37/231 |
| 5,235,308 | A | * | 8/1993 | Shimada et al. | 337/377 |
| 5,381,647 | A | * | 1/1995 | Eberle | 56/15.8 |
| 5,393,194 | A | * | 2/1995 | Smith | 414/546 |
| 5,435,082 | A | * | 7/1995 | Frenette et al. | 37/235 |
| 5,615,745 | A | * | 4/1997 | Cross | 172/811 |
| 5,662,451 | A | * | 9/1997 | Muzzi et al. | 414/540 |
| 5,666,747 | A | * | 9/1997 | MacQueen | 37/273 |
| 5,707,072 | A | * | 1/1998 | Hopper | 280/491.5 |
| 5,778,567 | A | * | 7/1998 | Jager et al. | 37/235 |
| 5,909,960 | A | | 6/1999 | Jager | |
| 5,950,336 | A | | 9/1999 | Liebl | |
| 5,947,496 | A | * | 10/1999 | Ulrich et al. | 254/326 |
| 6,104,099 | A | * | 8/2000 | Mizuta et al. | 307/9.1 |
| 6,178,668 | B1 | * | 1/2001 | Gustafson et al. | 37/231 |

* cited by examiner

*Primary Examiner*—Daniel G. DePumpo
*Assistant Examiner*—James S. McClellan
(74) *Attorney, Agent, or Firm*—Robert L. Harrington

(57) ABSTRACT

An actuator for raising and lowering a blade mounted to a vehicle. A winch assembly is mounted to the blade and is powered by the vehicle battery. The motor has a low amperage draw and has a gear reduction unit to provide mechanical advantage. The cable extending from the winch is arranged to have a double pull to provide an additional mechanical advantage.

10 Claims, 3 Drawing Sheets

WINCH ACTUATOR FOR ATV

FIELD OF THE INVENTION

This invention relates to a winch for use on an all terrain vehicle (ATV) for actuating an implement mounted on the ATV, e.g., for raising and lowering a plowing blade.

BACKGROUND OF THE INVENTION

All terrain vehicles are small four-wheel vehicles, typically about four feet wide and about six feet long. They are designed to carry one or two persons over all types of terrain, both on road and off road use. Whereas they were originally considered a recreational vehicle, their use has developed into all manner of practical applications. Because of their small size, they can be driven on sidewalks and along trails typically reserved for pedestrians, motorcycles, bicycles and horseback riders, and not motorized vehicles.

They are a favorite form of transportation in camp grounds, farms and similar environments. They are provided with hitches for towing wagons that can carry a load, with plows for plowing snow and dirt, and with winches for getting the ATV unstuck and for aiding hunters in skidding large game out of a forest.

There are limitations, however, in that the ATV is a small vehicle with corresponding power capability. Whereas their light weight allows for the use of small inexpensive engines with corresponding accessory components, e.g., alternators and batteries, the power availability for such implements as electrically powered winches is limited. There is also the problem of cost. A typical winch mounted to a conventional four-wheel drive vehicle can cost 10–20% of the entire cost of the ATV and in any event have a very restricted use as the ATV does not provide enough power to fully utilize the capability of a conventional winch.

The present invention was prompted by the need to solve a particular problem. The above-mentioned snow plow blade addition to an ATV requires that the blade be mounted so that it can be repeatedly raised and lowered. In the lowered position, the blade rests on the ground surface so that snow or other debris on the ground surface (e.g., a sidewalk) can be pushed or bladed off the surface. However, to maneuver the ATV into different positions during operation, the blade needs to be raised and lowered repeatedly.

Prior to the present invention, the raising and lowering of the blade was most often provided by a hand lever mechanically linked to the blade. The ATV operator had to physically muscle the blade to a raised position. Alternatively, a traditional winch which may be mounted to the ATV, e.g., for the purpose of getting the ATV unstuck or for hunting, may be additionally applied to the task of raising and lowering the blade. However, repeated or improper use of the winch can rapidly drain the battery of the ATV and as previously mentioned, the cost is prohibitive for the many users who only want a power assist for raising and lowering the plow blade (or similar implement attachment for the ATV).

BRIEF DESCRIPTION OF THE INVENTION

The present invention addresses the problem of providing power assist for operating implement attachments to an ATV such as a plow blade. The object is to use the available power of the ATV while maintaining cost objectives and also to provide both convenience and safety of operation. Whereas such implements as snow plow blades are a secondary benefit of an ATV, the implement preferably will also be readily mountable and demountable from the ATV. Hereafter the invention is described with reference to a snow plow blade but it is to be understood that, as applicable, encompassed are all implements having similar power assist requirements.

In a preferred embodiment, the power source for operation of the snow plow blade is a small electric motor having low amperage operation and need only for light wiring. A simple gear set up drives a drive gear mounted to a winch drum designed, e.g., to operate having about 4 to 4½ feet of cable. A double line lift arrangement provides for a mechanical advantage that further reduces the power need, i.e., the winch winds up 20 inches of cable to lift the blade 10 inches, the typical clearance height provided for such blades. The electric motor is provided with a dynamic brake to prevent back drop of the blade when raised off of the surface. The motor further includes a self-governing feature, e.g., a thermal protector that shuts the motor down in response to overheating. The short winch cable and the thermal protector prevent misuse of the winch, e.g., for pulling heavy objects or for extended periods of use.

Other features that provide improvement in the use of the lift winch are:

(a) The winch assembly is preferably mounted to the blade rather than the ATV so that the de-mounting of the blade also provides de-mounting of the winch assembly.

(b) Operation of the lift winch is provided by a hand control mounted to the ATV handle bars.

(c) A quick connect mechanism disconnects the wiring to the winch so that the hand control can remain on the ATV handle bars while the blade and winch motor are stored for the winter season.

(d) The double line pull arrangement simply requires a pulley that is attached to the ATV frame. Removal of the cable from the pulley is provided by a removable pulley wheel.

(e) The wiring is provided with a safety switch which is connected to the ATV's ignition switch and cannot be operated without the ATV ignition switch turned on.

(f) The cable is connected to the winch drum to provide for winding of the cable on the drum in either direction thus avoiding a problem of loosening the cable from the drum.

These and other advantages will become apparent upon reference to the following detailed description and the drawings referred to therein.

DESCRIPTION OF THE PREFERRED EMBODIMENT

Figure 1:
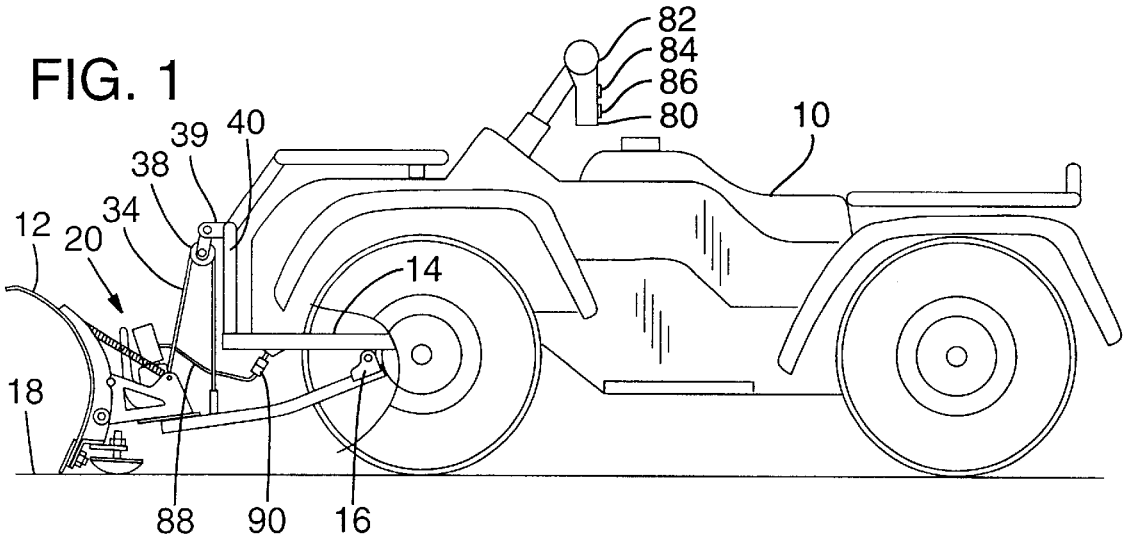
FIG. 1 is a view of the winch actuator of the present invention applied to an all terrain vehicle for elevating and lowering a plow blade.

FIG. 1 illustrates a vehicle 10 often referred to as an all terrain vehicle (ATV). The vehicle 10 was initially provided as an recreational vehicle but soon was adapted to be utilized in many other operations such as towing trailers, lawn sweepers and the like and the application of blades for moving snow. In this embodiment, the vehicle 10 has a blade 12 mounted to the front of the vehicle 10 with a blade 12 being suited for moving snow. The blade 12 is pivotally mounted to the frame 14 of the vehicle 10 on suitable brackets 16. The blade 12 is pivotally movable upwardly away from a supporting surface 18 and downwardly toward the supporting surface 18. In this embodiment the blade 12 is moved upwardly and downwardly by a winch assembly 20 that is mounted to the blade 12.

The vehicle 10 is of the type that generally does not have a large capacity battery nor a generating system that has a high output. It is therefore necessary that the motor that drives the winch has a low power requirement. The winch assembly 20 of the present invention fills that need.

Figure 2:
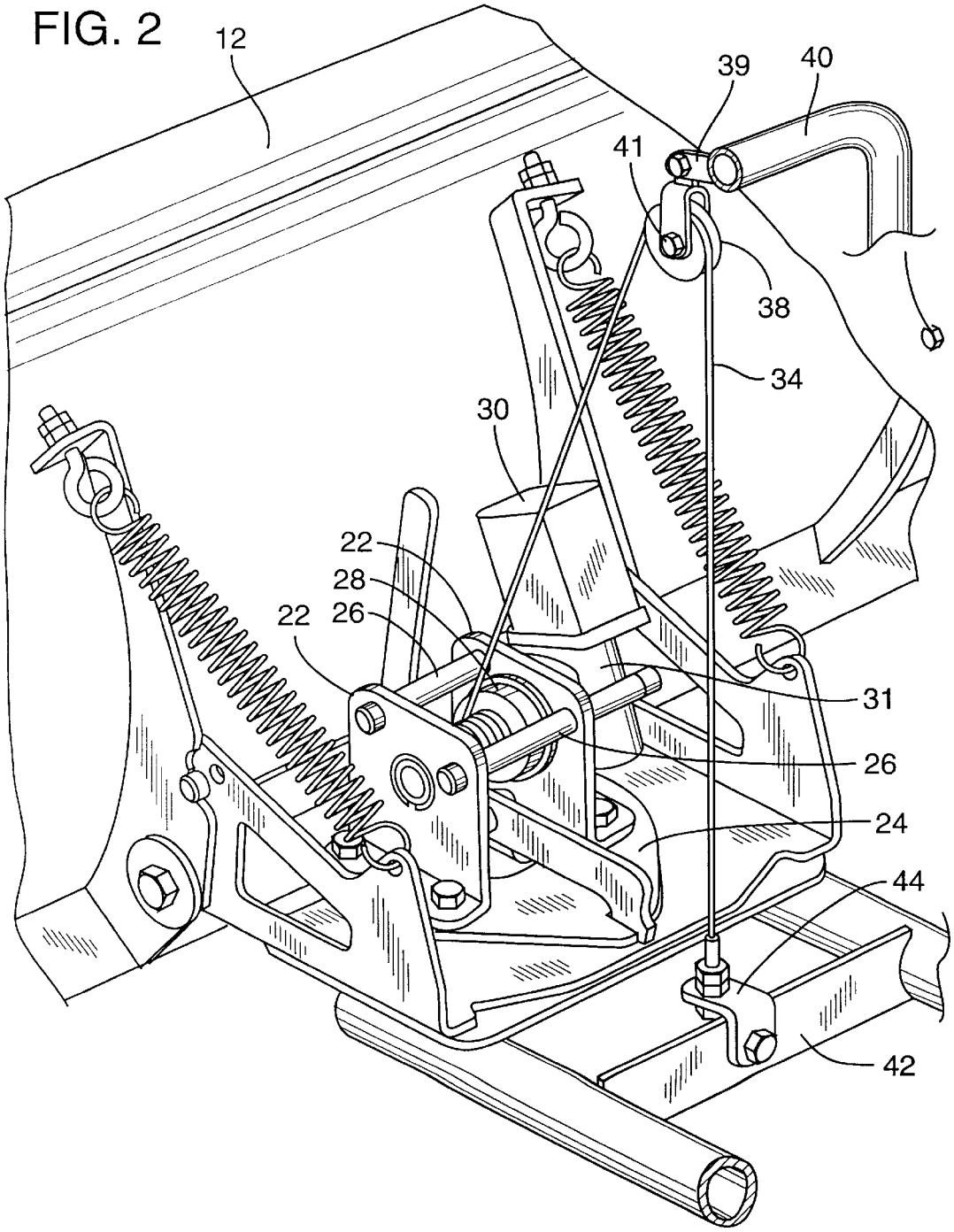
FIG. 2 is a view of a winch assembly mounted to the plow blade of FIG. 1.

FIG. 2 further illustrates the winch assembly 20 mounted to the blade 12. Brackets 22, which support a drum and motor assembly of the winch 20, are fixedly mounted to a base plate 24 of the blade 12. As shown, the brackets 22 are spaced a sufficient distance apart by spacers 26 which accommodate the mounting of the cable drum assembly 28. The drum 28 is reversibly driven by a motor assembly 30. The motor assembly 30 includes a housing 31 which has a gear reduction unit coupled to the motor.

The drum 28 driven in one direction will deploy cable 34 off the drum 28 and the drum 28 rotatably driven in the opposite direction will reel cable onto the drum 28. The cable 34 extends from the drum 28 to a support pulley 38 mounted to a bracket 39 on a cross member 40 of the vehicle 10. The end of the extended cable 34 is secured to a cross member 42 of the blade 10 on a bracket 44. The pulley 38 is removable from the bracket 39 by removal of the bolt 41.

The arrangement of the cable connection between the blade 12 and the vehicle 10 provides an additional mechanical advantage by the double pull.

Figure 3:
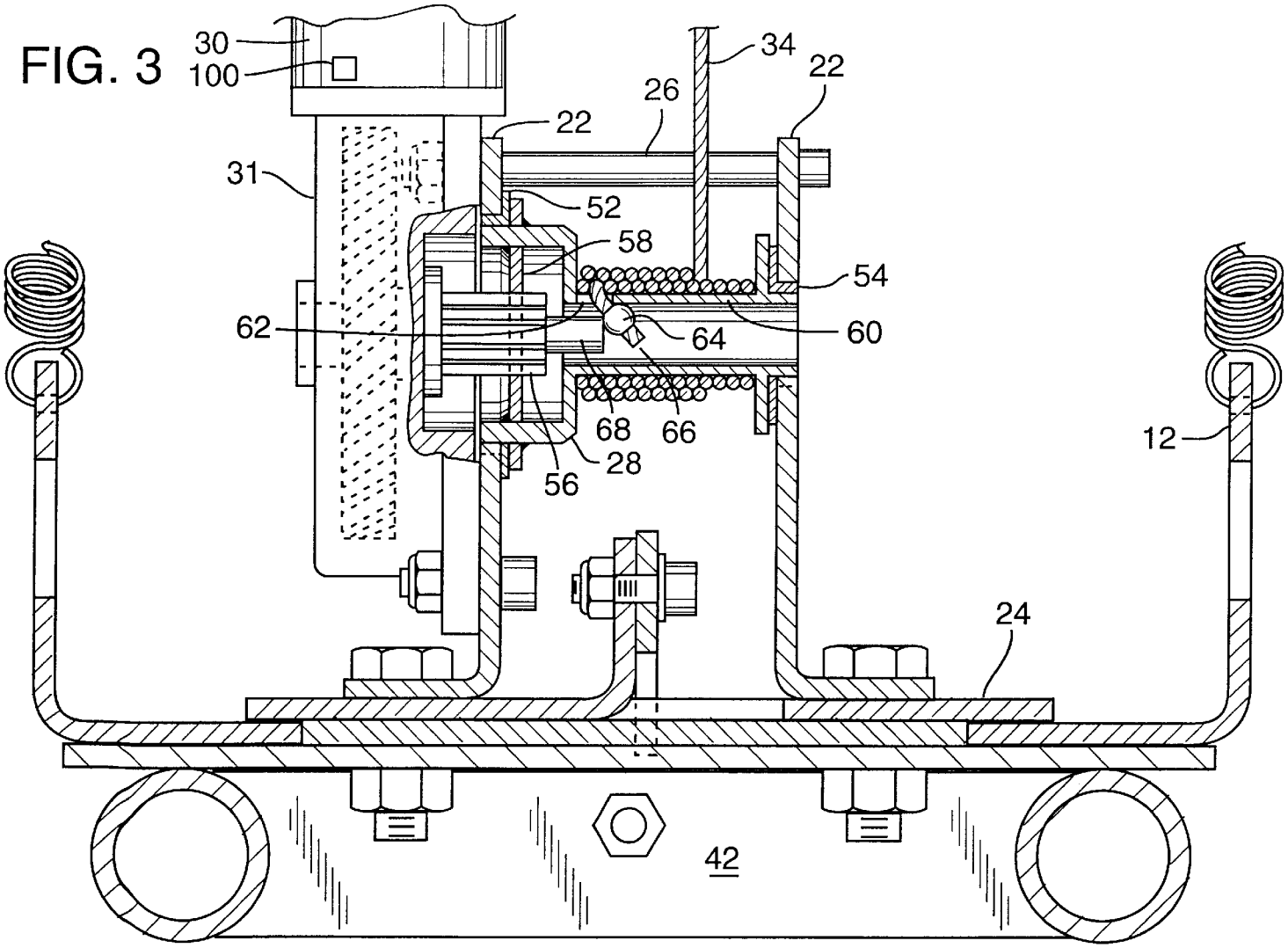
FIG. 3 is a sectional view of the winch assembly mounted to the plow blade of FIG. 2; and, FIG. 4 is a partial view of a handlebar of the vehicle of FIG. 1 illustrating a control for the winch.

FIG. 3 is a sectional view of the winch 20 which further illustrates the mounting arrangement of the cable drum 28 to the brackets 22 and the manner of inserting the end of the cable 34 into the cable drum 28. The cable drum 28 is rotatably supported in bearings 52 and 54 that are mounted in the brackets 22 of the winch assembly. A housing 31 of the motor assembly 30 is mounted on one of the brackets 22 strategic to the drum 28. When installed the housing has a spline shaft 56 in engagement with a drive member 58 of the cable drum 28.

The cable drum 28 has a center tube 60. The tube 60 has an aperture 62 that is sized to permit the insertion of a ball 64 fixedly mounted on the end 66 of the cable 34. The end 66 of the cable is inserted through the aperture 62 to reside within the tube 60. The end 66 of the cable 34 is inserted into the tube prior to the mounting of the housing 31. When the housing 31 is installed, the stub shaft 68 projects into the tube 60 to prevent the ball 64 from exiting through the aperture 62. The manner of securing the cable 34 to the drum 28 permits reeling the cable onto the drum in either direction of drum rotation without kinking the cable.

Figure 4:
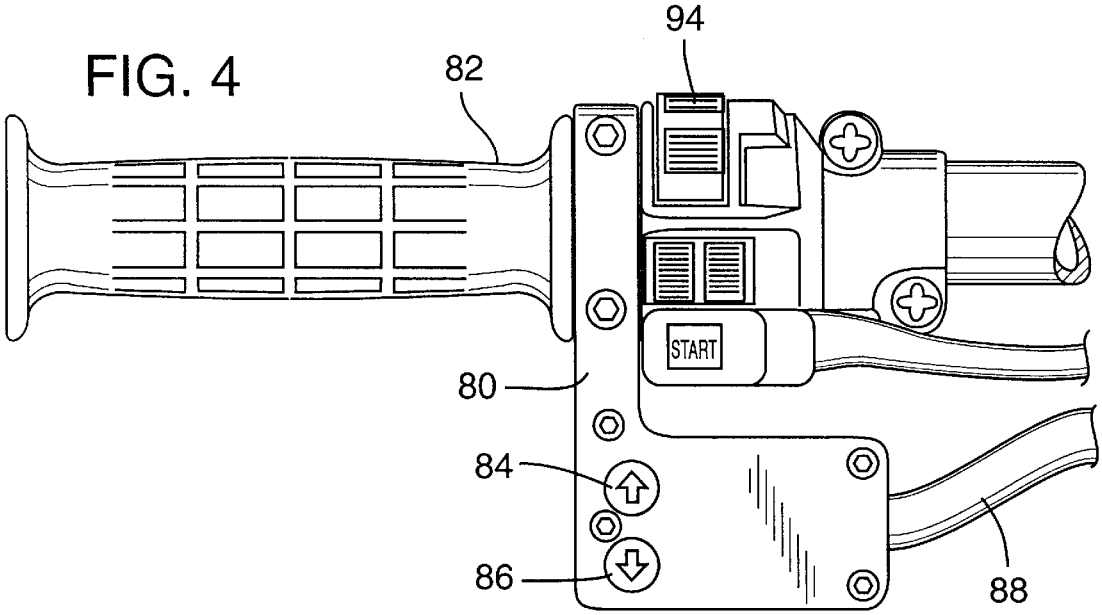

A housing 80 is mounted to a handlebar 82 of the vehicle 10 as shown in FIG. 4. The housing 80 has push button switches 84 and 86 to provide power to the motor 30. When switch 84 is depressed power will be supplied to the motor 30 to rotate the motor in one direction and when switch 86 is depressed power will be supplied to the motor 30 to rotate the motor 30 in the opposite direction. A cable 88 connects the housing 80 to the motor 30. A quick dis-connect 90 (FIG. 1) is provided to enable dis-connecting the cable 88 when the blade 12 is removed from the vehicle 10.

The cable 88 is coupled to the circuit of the ignition switch 94. Power is only supplied to the switch housing 80 (switches 84 and 86) when the ignition switch is in the on position.

The motor 30 is provided with a thermal overload protector 100 (FIG. 3) to protect the motor from overload conditions. The motor 30 is dynamically braked when power is off to prevent the blade 12 from lowering.

The blade 12 is removed from the vehicle 10 by uncoupling the cable 88 at the quick dis-connect 90, uncoupling the mounting of the brackets 16 from the frame 14 and dis-connecting the pulley 38 from the bracket 39. The winch assembly 20 thus remains on the blade 12.

Those skilled in the art will recognize that modifications and variations may be made without departing from the true spirit and scope of the invention. The invention is therefore not to be limited to the embodiments described and illustrated but is to be determined from the appended claims.

What is claimed is:

1. A vehicle including a working implement comprising:

a driver-only vehicle designed for travel on walkways and paths typically designated for pedestrian and bicycle use and not for use by a standard passenger vehicle that is many times greater than said passenger-only vehicle in size and weight, said driver-only vehicle including a battery and a battery recharging system having low amperage storage and low amperage recharging capability not suitable for powering winches provided as an accessory for said standard passenger vehicle, said standard passenger vehicle having many times greater battery storage capability and battery recharging capability, said driver-only vehicle characterized as an all terrain vehicle;

a winch mounted to said all terrain vehicle, said winch including a drum, a cable mounted an the drum and a motor, said motor operable at an amperage draw compatible with the amperage storage capability and amperage output capability of said battery and recharging system of said all terrain vehicle; and a working implement having a movable component operable by said winch of said all terrain vehicle for performing a working task, said movable component operable by said winch for performing said working task and generating an amperage draw from said battery that does not exceed the recharging capability of said all terrain vehicle recharging system, which accordingly allows repeated and lengthy operation of the winch without depleting the storage capacity of the battery.

2. A vehicle as defined in claim 1 wherein the motor and winch are dedicated to implement operation, said winch including a thermal protector that shuts the motor off when subjected to power demand in excess of the capability of said battery and alternator of said all terrain vehicle.

3. A vehicle as defined in claim 2 wherein the cable is limited in length to inhibit use of the winch for pulling the weight of the vehicle.

4. A vehicle as defined in claim 1 wherein the cable is secured at one end to the drum to permit winding of the cable onto the drum in either direction.

5. A vehicle as defined in claim 1 wherein the vehicle is provided with handle bars for an operator of the vehicle and an ignition switch for starting the vehicle engine, an electric cable extended from the motor to a hand control mounted adjacent or on the handle bars, and said electric cable connected to the ignition switch to prevent operation of the implement without engagement of the ignition switch.

6. A vehicle as defined in claim 1 wherein the winch is mounted to the implement whereby removal and storage of the implement also removes and stores the winch.

7. A vehicle as defined in claim 1 wherein the winch is mounted to the implement a pulley provided on the vehicle elevated above said implement, said cable extended from the winch through the pulley and anchored to the implement whereby the cable is multiple lined to provide a mechanical advantage to the motor and reduction of the power demand on the battery.

8. A vehicle as defined in claim 4 wherein the drum is cylindrical and defines a center cavity, said one end of the cable inserted into the drum cavity with the cable projected radially out of the drum whereby the cable is equally wound onto the drum in either direction of drum rotation.

9. A vehicle including a working implement comprising:

a driver-only vehicle designed for travel on walkways and paths typically designated for pedestrian and bicycle use and not for use by a standard passenger vehicle that is many times greater than said passenger-only vehicle in size and weight, said driver-only vehicle including a battery and a battery recharging system having low amperage storage and low amperage recharging capability not suitable for powering winches provided as an accessory for said standard passenger vehicle, said standard passenger vehicle having many times greater battery storage capability and battery recharging capability, said driver-only vehicle characterized as an all terrain vehicle;

a winch mounted to said all terrain vehicle, said winch including a drum, a cable mounted on the drum and a motor, said motor operable at an amperage draw compatible with the amperage storage capability and amperage output capability of said battery and recharging system of said all terrain vehicle;

a working implement having a movable component operable by said winch of said all terrain vehicle for performing a working task, said movable component operable by said winch for performing said working task and generating art amperage draw from said battery that does not exceed the recharging capability of said all terrain vehicle recharging system;

said vehicle including front and rear wheels and a frame structure having a bottom portion that extends forwardly along the vehicle bottom to a position forward of the front wheel and an upper portion that extends upwardly at the front end of the vehicle;

said implement including a plow blade mounted forward of the vehicle and a support arm extended from the plow blade to a position on the bottom portion of the frame structure rearward of at least a portion of the front wheel, and a pivotal connection pivotally connecting the support arm to said bottom portion rearward of at least a portion of the front wheel; and a pulley mounted to said upper portion of the frame structure and positioned above the support arm and said winch cable extending from the winch and through the pulley and down to the support arm for pivotal raising and lowering of the blade around said rearward pivotal connection.

10. A vehicle as defined in claim 9 wherein said winch is mounted on said support arm which is raised and lowered with said blade and thereby providing double line lifting advantage.

* * * * *